US006112417A

United States Patent [19]

Hyer et al.

[11] Patent Number: 6,112,417

[45] Date of Patent: Sep. 5, 2000

[54] PRECISION VINYL & CARPET TRIMMER

[76] Inventors: Michael L. Hyer, 835 W. Gaucho Cir., Deltona, Fla. 32725; Raymond E. Hyer, 2194 Saragossa Ave., DeLand, Fla. 32724

[21] Appl. No.: 09/026,662

[22] Filed: Feb. 20, 1998

[51] Int. Cl.[7] ..... B26B 29/06

[52] U.S. Cl. ..... 30/290; 30/293; 30/294; 30/315

[58] Field of Search ..... 30/286, 287, 293, 30/294, 280, 288, 289, 292, 314, 315, 317, 290, 320; 33/41.1, 527

[56] References Cited

U.S. PATENT DOCUMENTS

| | | | |
|---|---|---|---|
| 944,019 | 12/1909 | Conrow | 30/293 |
| 2,007,396 | 7/1935 | Howard | 30/292 |
| 2,238,678 | 4/1941 | Cook | 30/294 |
| 2,607,115 | 8/1952 | Iovinelli | 30/293 |
| 2,966,742 | 1/1961 | Harian | 30/314 |
| 3,009,247 | 11/1961 | Mueller | 30/294 |
| 3,363,314 | 1/1968 | O'Brien | 30/293 X |
| 3,395,453 | 8/1968 | Prater | 30/294 X |
| 3,678,586 | 7/1972 | Weber | 30/289 X |
| 3,837,078 | 9/1974 | Weppner | 30/293 |
| 3,844,038 | 10/1974 | Kelly et al. | 30/293 |
| 3,859,725 | 1/1975 | Anderson et al. | 30/294 |
| 3,875,664 | 4/1975 | Diner | 30/293 X |
| 4,001,936 | 1/1977 | Matsushita | 30/287 |
| 4,148,142 | 4/1979 | Sullivan et al. | 30/293 |
| 4,262,418 | 4/1981 | Hill et al. | 30/287 |
| 4,349,966 | 9/1982 | Marino et al. | 30/289 X |
| 4,549,351 | 10/1985 | Stanbery et al. | 30/293 |
| 5,044,081 | 9/1991 | Nguyen | 30/294 |
| 5,353,508 | 10/1994 | Baker | 30/294 X |

FOREIGN PATENT DOCUMENTS

| | | | |
|---|---|---|---|
| 27 24 915 | 12/1978 | Germany | 30/293 |
| 8801141 | 12/1989 | Netherlands | 30/294 |

*Primary Examiner*—Clark F. Dexter
*Attorney, Agent, or Firm*—Julian C. Renfro, Esq.

[57] ABSTRACT

A hand operated trimmer for trimming an edge of vinyl, carpet or the like being installed on a floor so that the cut edge of the floor covering will lie closely against an adjacent wall. The trimmer comprises an elongate base member and an integral cutting blade. The base member has a generally triangularly shaped cross section, with two of the elongate external surfaces of the base member meeting at a right angle, and the elongate external surface opposite the right angle being a concave surface. The cutting blade is mounted closely adjacent the concave surface and in a substantially perpendicular relationship thereto. Pressure applying rollers are spaced a slight distance from the concave surface so as to define a vinyl-receiving entry location for a vinyl sheet to pass in a longitudinal direction along the concave surface, with the pressure applying rollers serving to keep the vinyl sheet in close contact with the concave surface. The cutting blade is mounted in alignment with the path of travel of the vinyl along the concave surface, whereby upon an installer causing a vinyl sheet to enter the entry location, the external surfaces of the base member meeting at a right angle can be moved longitudinally along the floor-wall intersection. At that time the blade cuts the vinyl at a location coinciding with the intersection of the floor with the adjacent wall, such that the cut edge of the vinyl will reside closely and evenly along the wall.

27 Claims, 6 Drawing Sheets

FIG 4
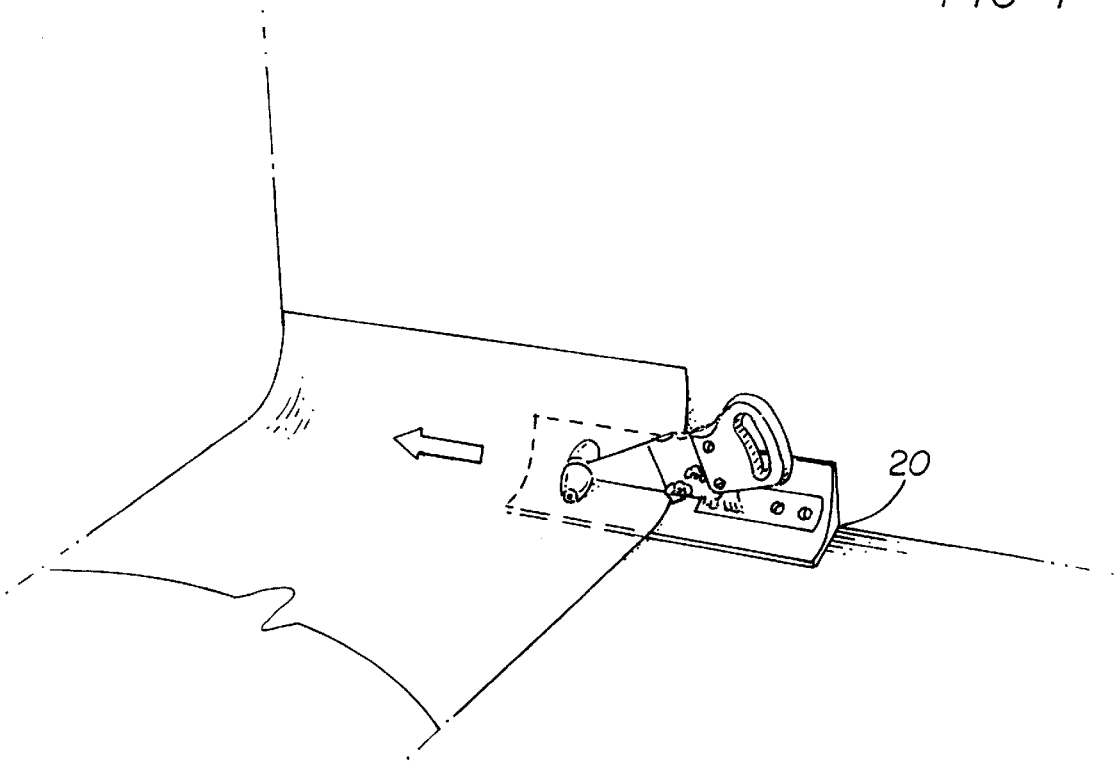
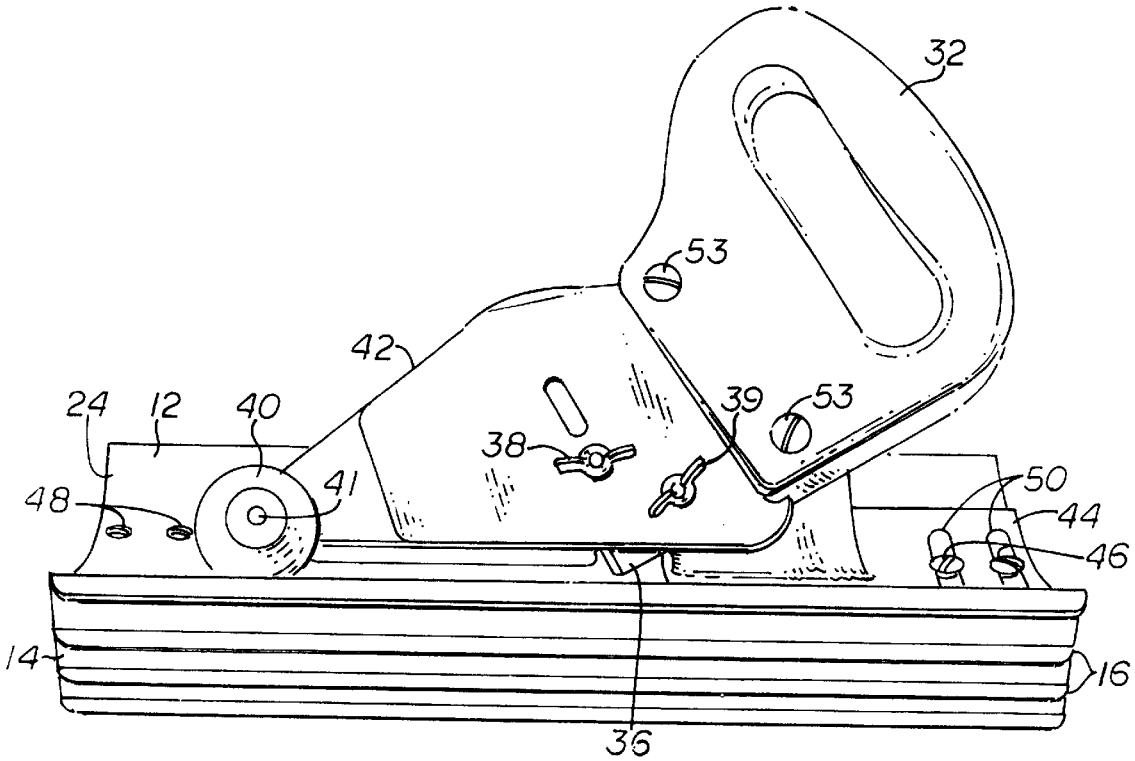
FIG 5

FIG 6
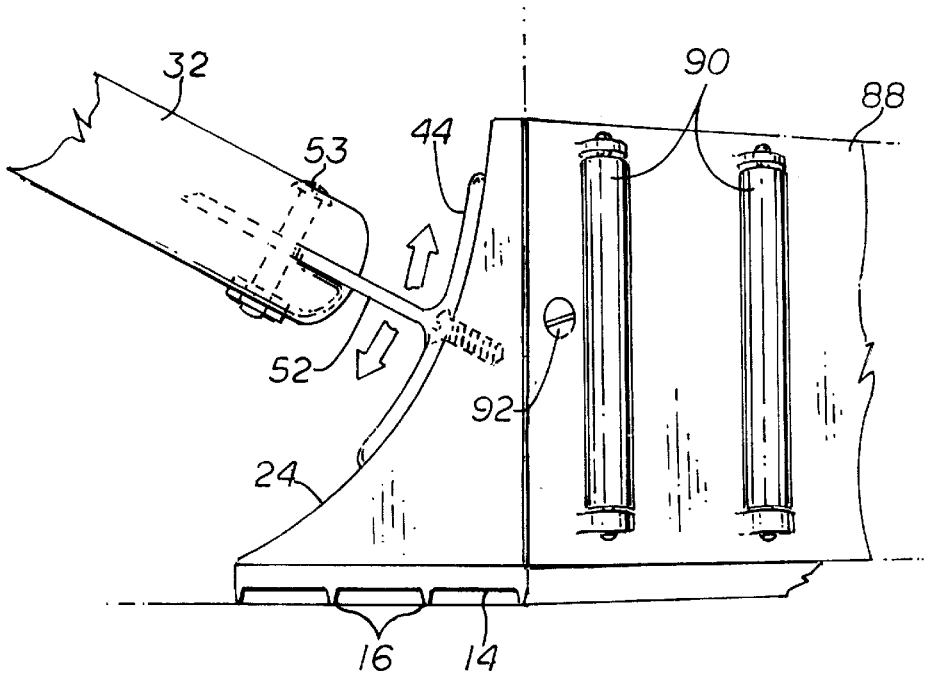
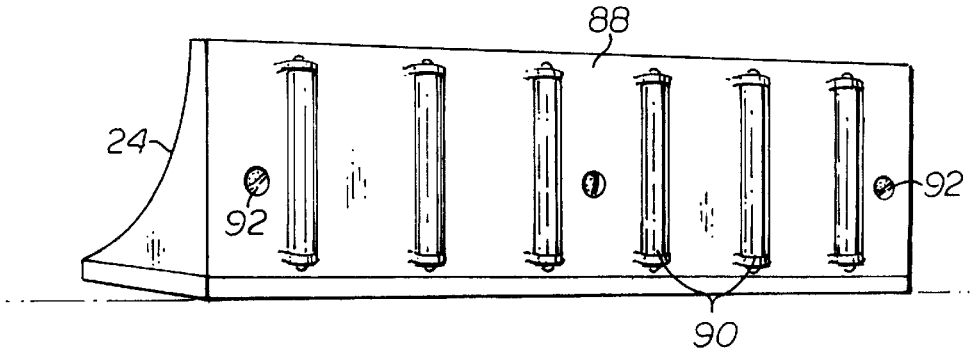
FIG 7

FIG 9
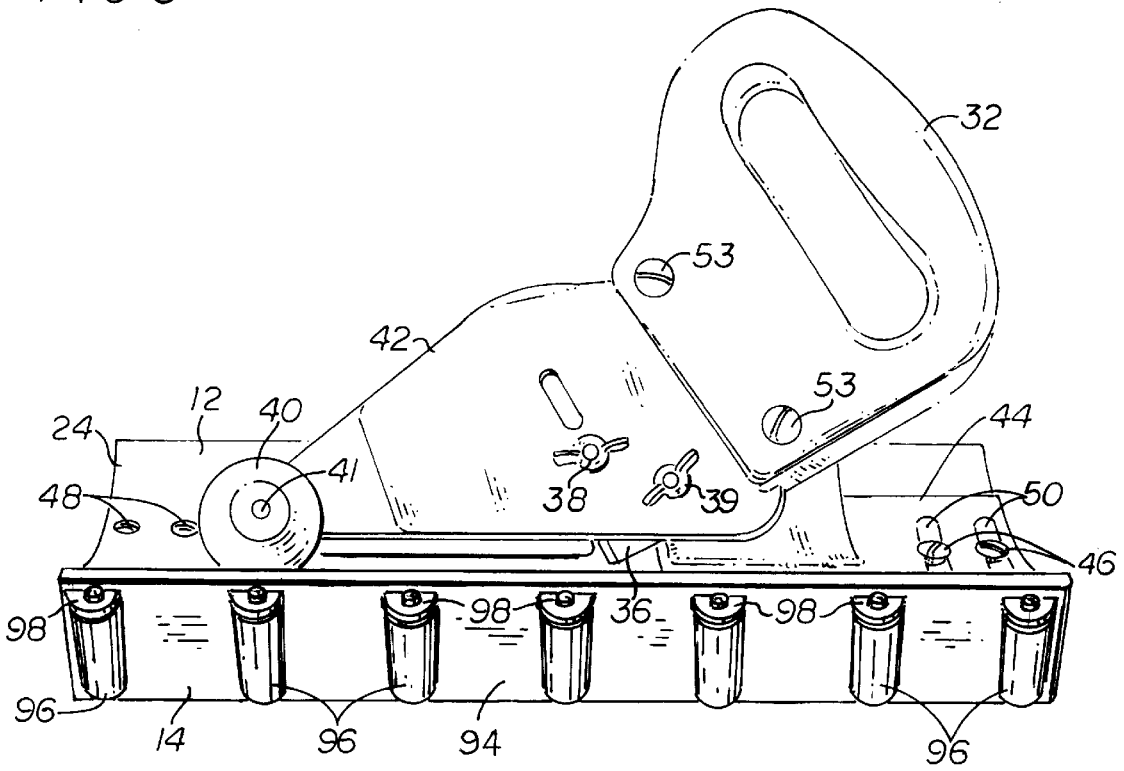
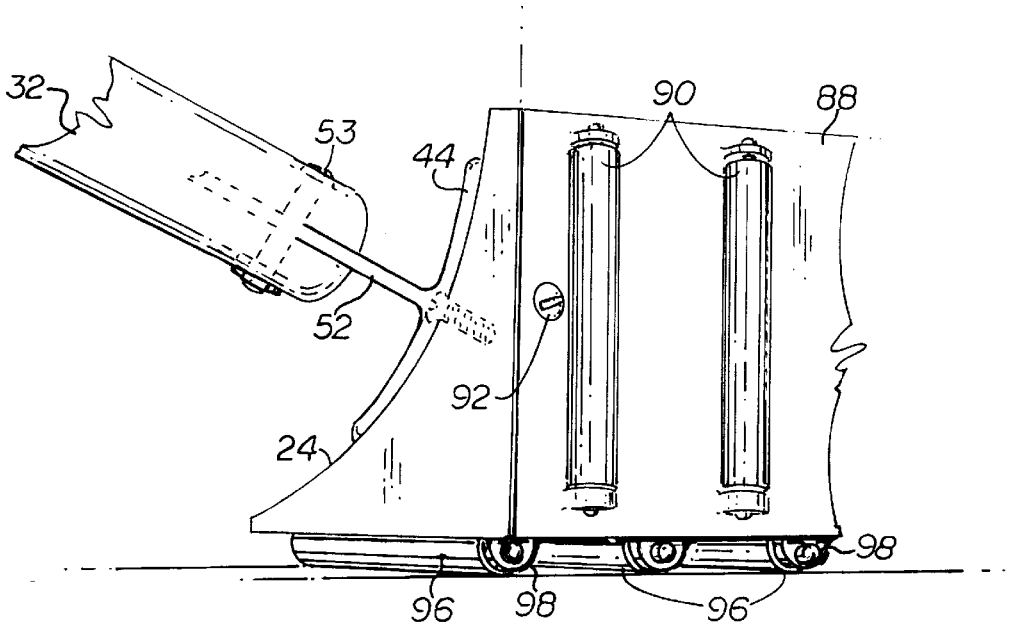
FIG 10

PRECISION VINYL & CARPET TRIMMER

BACKGROUND OF THE INVENTION

In the installation of a vinyl floor covering, the cutting of the edge of a sheet of vinyl so that it fits tightly up against the wall of the room has always involved a substantial amount of skill upon the part of the installer.

Typically the installer pushes the upwardly curved edge of the vinyl fairly tightly into the intersection of the floor and the wall, and if the vinyl is not too thick, the vinyl can perhaps be creased somewhat, in a non-damaging way. Such creasing serves to identify reasonably well to the installer, the precise location where the cut is to take place, so that the freshly cut edge of the vinyl will lie closely against the wall. On the other hand, if the vinyl is thick, more of an approximation on the part of the installer must be made as to the location where the cut is to be effected.

The cutting of the vinyl is usually accomplished by the use of a conventional, hand-held cutter. From the end of the handle of such cutter, the pointed edge of a very sharp blade protrudes. So as not to risk damaging a new sheet of vinyl so seriously as to make it unusable, even an experienced installer will likely make an oversize first cut. Then, after the conspicuously unnecessary material has been removed, it is possible for the installer to make a closer cut, but frequently a still further cut or two must be made until the cut edge of the vinyl closely conforms to the wall.

Even though the final cut will result in the edge of the vinyl lying rather closely against the wall, often the cut made by the installer is somewhat wavering rather than being entirely straight, meaning that a bead of sealer or the like must be used in an attempt to hide the irregularly cut edge of the vinyl.

Certain patents dealing with the problem have already been issued, with the Weber U.S. Pat. No. 3,678,586, relating to Carpet-Trimming Templates being somewhat typical. The Weber template is a stationary device, which is to be placed at the intersection of the floor and the wall. When using the Weber device, it is necessary for the installer to pull a separate, hand-held blade along a knife-receiving slot in order to cut the carpet. Most important, it is frequently necessary for the installer to pick up the Weber template and move it to each new location, which of course means that the template must be repositioned a number of times during the procedure in which the edge of the carpet nearest the wall is being cut to size.

The Hill et al U.S. Pat. No. 4,262,418, entitled "Boot For Trimmer For Resilient Floor Covering Material," provides a handle to be grasped by the installer in order to cause a blade to move along the location of the floor covering that is to be cut. It will be noted that Hill et al configures his device to have a curved wall member designed to rest on top of the floor covering, and to press directly against the upwardly curving floor covering. Hill utilizes a blade (actually two blades) at approximately a 45° angle to the floor, which blade is caused to move along the floor covering as the installer draws the handle along a location relatively near the intersection of the floor and wall. However, the Hill device, upon being pressed tightly against the upper surface of the vinyl being installed, is likely to cause scratch marks on the surface of the vinyl. Even more important, if the Hill device is being utilized in connection with the installation of a stiff piece of vinyl, it would be almost impossible to force the vinyl into the juncture between the floor and the wall. In addition, with nothing under the vinyl to use as a cutting guide, it would be almost impossible for the installer to achieve an even, straight cut. In other words, use of the Hill device would provide only a very rough approximation of the location where the floor covering needs to be cut in order for the cut edge to lie closely against the wall.

It was to overcome the distinct disadvantages of these and other prior art patents that the instant invention was created.

SUMMARY OF THE INVENTION

In accordance with this invention we have provided a hand operated trimmer for trimming an edge of vinyl, carpet or other such floor covering, comprising an elongate base member having a generally triangularly shaped cross section. Two of the elongate external surfaces of the base member meet at a right angle, whereas the elongate external surface opposite the right angle involves a vinyl-receiving surface. Although the vinyl-receiving or vinyl-contacting surface could be flat or nearly flat, we prefer for this to be a surface of concave or arcuate configuration. A cutting blade is operatively mounted above and in an adjacent relationship to the concave vinyl-contacting surface, so that upon the base member being moved on its longitudinal axis along the floor-wall juncture, the blade cuts the vinyl is such a precise manner that the cut edge of the vinyl can be expected to fall closely and evenly against the wall.

The vinyl trimmer in accordance with this invention has a cutter assembly comprising a handle, a height adjustment means for the cutting blade, and pressure applying means for applying pressure to vinyl residing along the length of the vinyl-contacting surface of concave configuration. The pressure applying means, preferably involving a pair of rollers, is spaced a slight distance from the concave surface so as to define a vinyl-receiving entry location leading to a path of travel for a vinyl sheet to pass longitudinally along the elongate concave surface. The cutting blade is mounted in a substantially perpendicular relationship to the concave surface and in alignment with the path of travel of the vinyl along the concave surface. As a result of this construction, upon an installer grasping handle and inserting the device with an edge of a vinyl sheet entering the entry location, the installer is able to move the external surfaces of the base member meeting at a right angle along the intersection of the floor with the wall. The cutting blade functions to cut the vinyl at a location coinciding with the intersection of the floor with the adjacent wall.

In the preferred embodiment, the cutting blade is supported from a mounting base having a configuration substantially consistent with the curvature of the curved or concave surface, with the mounting base mounted in a laterally adjustable manner upon the concave surface. This lateral adjustability of the mounting base makes it readily possible for a user to adjust the distance between the tip of the cutting blade and the floor, such that the user can assure that the cut edge of the vinyl will coincide with the location of the adjacent wall.

It is thus to be seen that an object of this invention is to provide a hand operated trimmer for trimming an edge of vinyl, carpet or the like, involving an elongate blade-carrying device designed to be moved along a floor-wall intersection, with the blade being positioned to cut a sheet of vinyl in a very precise manner, such that the cut edge of the vinyl will lie closely against the wall.

It is another object of this invention to provide a vinyl cutter configured to be moved along the floor-wall intersection and enabled to cut a sheet of vinyl by a substantially continuous motion of our cutter along a sheet of vinyl or other floor covering, making obsolete the previously used devices needing to be repeatedly repositioned during the cutting procedure.

It is yet another object of this invention is to provide a hand operated trimmer for trimming an edge of vinyl, carpet or other floor covering, involving an elongate base member having a generally triangularly shaped cross section, with a cutting blade operatively mounted thereon, with the base member having longitudinally extending floor-contacting and wall-contacting members designed to be passed along a floor-wall intersection so as to enable the blade to accomplish a cutting of the vinyl in a precise relationship to the floor-wall intersection, such that the cut edge of the vinyl will lie closely against the wall.

It is yet still another object of this invention to provide a hand operated trimmer for trimming an edge of vinyl, carpet or the like, involving an elongate base member having a generally triangularly shaped cross section, which base member has elongate floor-contacting and wall-contacting surfaces meeting at essentially a right angle, with these surfaces designed to be passed along a floor-wall intersection, with the base member having an elongate curved surface opposite the right angle, along which curved surface the vinyl is able to move longitudinally, with a blade operably mounted closely adjacent the curved surface serving to accurately cut the vinyl at a location such that the freshly cut edge will rest closely along the floor-wall intersection.

It is yet still another object of this invention to provide a hand operated trimmer for trimming an edge of vinyl, carpet or other floor covering, involving an elongate base member having a generally triangularly shaped cross section, which base member has elongate floor-contacting and wall-contacting surfaces meeting at essentially a right angle, with these surfaces designed to be passed along a floor-wall intersection, with the base member having an elongate curved surface opposite the right angle, a mounting base having a configuration substantially consistent with the curvature of the concave surface, with the mounting base mounted in a laterally adjustable manner upon the concave surface, a cutter blade supported by the mounting base, with the lateral adjustability of the mounting base making it readily possible for a user to adjust the distance between the tip of the cutting blade and the floor, such that the user can assure that the cut edge of the vinyl will coincide with the adjacent wall.

These and other objects, features and advantages will be more apparent from a study of the appended drawings and the accompanying description.

BRIEF DESCRIPTION OF THE DRAWINGS

FIG. 4 is an idealized view revealing the general manner in which our novel hand held trimmer device is moved along the floor-wall intersection, with the cutting blade mounted on the device serving to cut the vinyl passing longitudinally across the concave surface in such a manner that the cut edge of the vinyl will lie closely against the wall when the trimmer has been removed;

FIG. 5 is a perspective view in which the vinyl cutter has been rotated so as to reveal the floor-contacting surface of the base member, with this view also revealing elongate slots in the mounting base supporting the blade member, with these elongate slots making it possible for the mounting base for the cutting blade to be adjusted in a lateral sense with respect to the concave front surface of the base member;

FIG. 6 is a cross sectional view bearing some resemblance to FIGS. 2 and 3, but here showing the mounting base to be attached at the appropriate location on the concave front surface of the base member, with the mounting base being laterally adjustable up or down the concave front surface so that the user can be assured that the cut edge of the vinyl will lie closely against the wall;

FIG. 7 is a view of an optional rear surface of the base member, in which a spaced series of vertically disposed rollers are provided in order that friction with the adjacent wall can be minimized;

FIG. 9 is a perspective view generally along the lines of FIG. 5, but in this instance illustrating a spaced array of rollers, disposed in a parallel relationship, that are utilized on the underside of the base member in order to be in a floor-contacting relationship with the floor when the hand operated trimmer is put into use; and FIG. 10 is a cross sectional view generally along the lines of FIG. 6, but in this instance illustrating rollers utilized on the underside of the base member and placed so as to engage and roll along the floor as the base member is moved along the floor-wall intersection.

DETAILED DESCRIPTION

Figure 1:
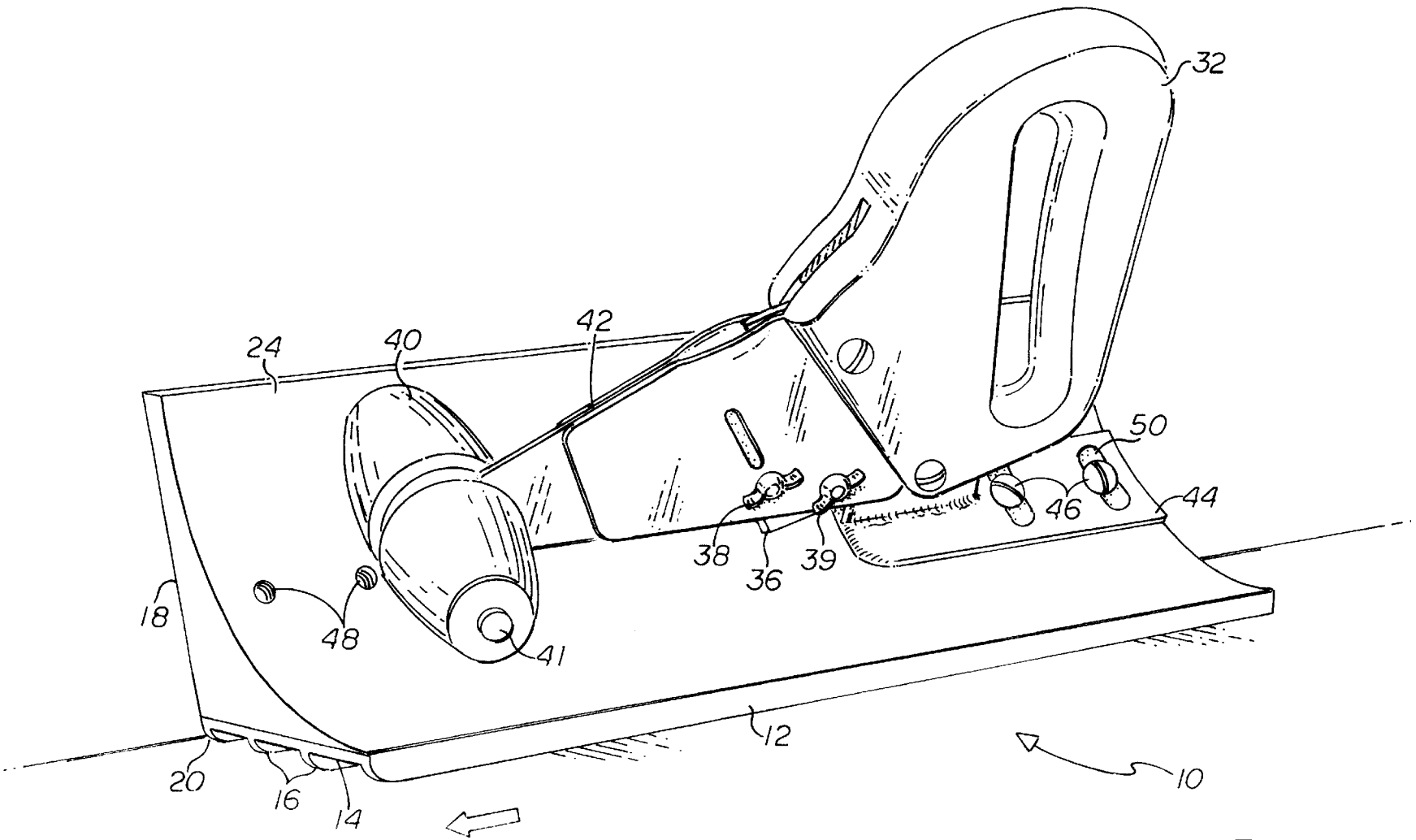
FIG. 1 is a perspective view of our novel trimmer device, with this view revealing an elongate base member having a generally triangularly-shaped cross section, with two of the elongate external surfaces of the base member meeting essentially at a right angle and adapted to be moved along the floor-wall intersection, with this device also having a concave front surface along which a sheet of vinyl or other floor covering can pass longitudinally, with this view also revealing a handle to be grasped by the vinyl installer, and pressure-applying rollers provided for maintaining a sheet of vinyl in close contact with the concave surface, so that the operatively mounted blade can cut the vinyl in a particularly straight and accurate manner.

With initial reference to FIG. 1, it will be seen that in accordance with this invention we have provided a cutter member 10 designed to be placed on the floor at the intersection of the floor with an adjacent wall and utilized for trimming vinyl or other floor covering so that the cut edge of the vinyl will closely conform with the floor-wall intersection. The cutter member 10 basically involves an elongate base member or angle block 12 having a generally triangularly-shaped cross section, as will best be seen in FIGS. 2 and 3. Two of the elongate external surfaces of the base member are essentially flat and meet essentially at a right angle, whereas the elongate surface opposite the right angle involves a surface 24 that we regard as a vinyl-receiving or vinyl-contacting surface. Although the surface 24 could be flat or have a somewhat different shape, we prefer for the surface 24 to be of concave or arcuate configuration so that the upwardly curving vinyl can lie smoothly thereagainst.

When we use the term "vinyl" in describing our invention, it is to be understood that we are using the term generically, and not in a limiting sense inasmuch as our novel device may be used quite well in the installation of certain other floor coverings provided in sheet form.

Figure 2:
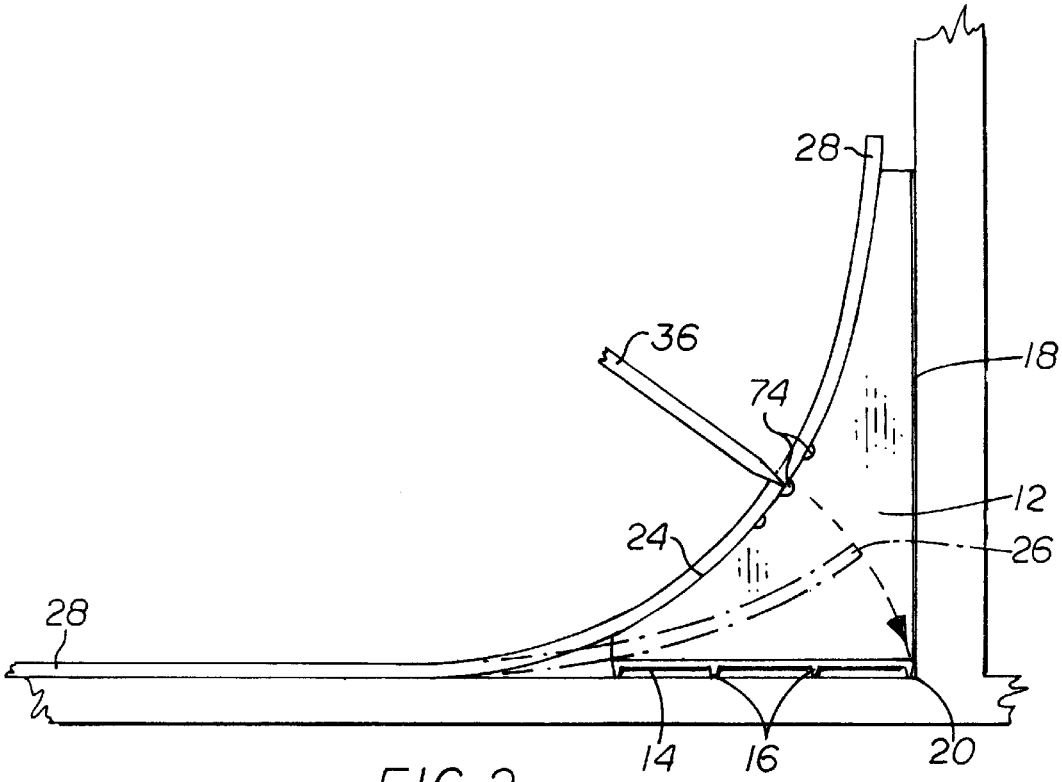
FIG. 2 is a cross sectional view revealing the generally triangular configuration of the elongate base member, with the typical location of the cutting blade being indicated, with the positioning of the blade being such as to cause the cut edge of the vinyl to lie closely against the wall after the cutting procedure has been concluded.
Figure 3:
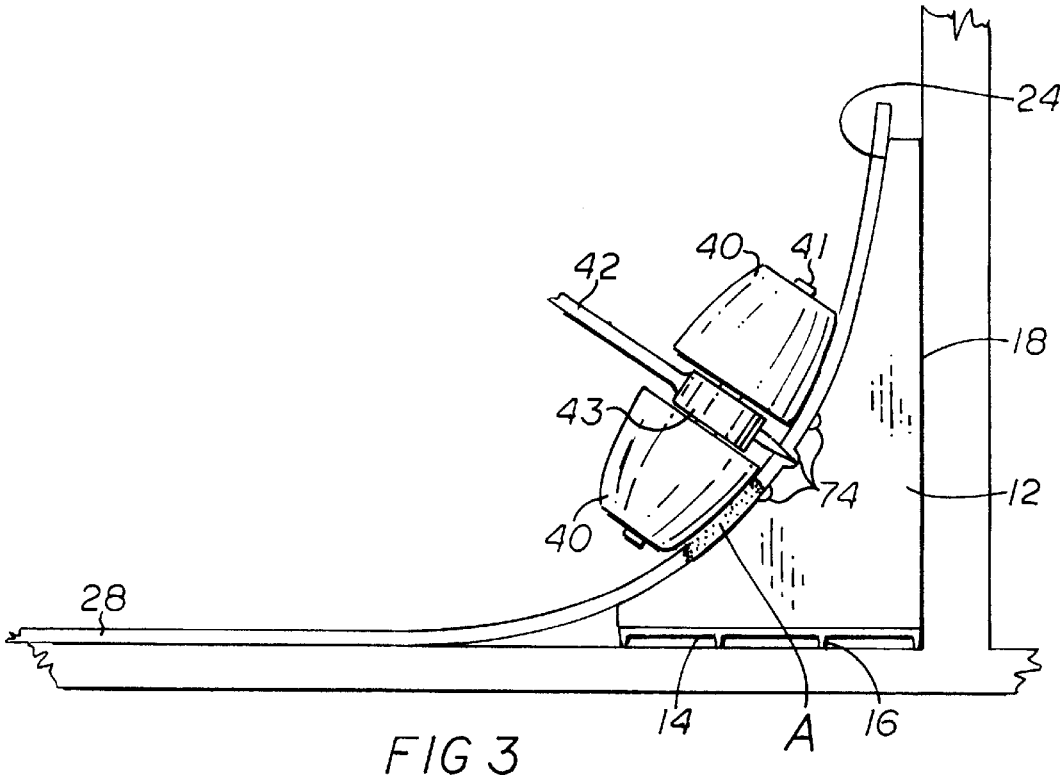
FIG. 3 is a cross sectional view closely along the lines of FIG. 2, but here showing the utilization of the pressure-applying rollers mounted in a cantilever manner on the front of the device, for holding the vinyl in close conformity with the concave front surface of the base member, with this view also depicting the vinyl-receiving aperture defined between the rollers and the concave surface.

As will be apparent from FIGS. 1 through 3, the elongate base member 12 has a floor-contacting surface 14, with the surface 14 of this embodiment of our invention preferably being constituted by a series of narrow floor-contacting components, such as longitudinally extending ridges or teeth 16. The ridges or teeth 16 are utilized on the undersurface or floor-contacting surface of the base member 12 for minimizing friction with the floor, and for preventing any binding action in the event of the presence of a cement or mastic on the floor. As will be mentioned hereinafter, we can use a series of narrow rollers on the floor-contacting surface in the interests of minimizing friction, but such rollers are not to be used when cement or mastic has already been applied.

Meeting at essentially a right angle with the floor-contacting surface 14 is a wall-contacting surface 18, clearly visible in FIGS. 1 through 3 and 6, with it to be understood in the use of our novel device, the user causes the floor-contacting undersurface 14 to move along the floor while at the same time the wall-contacting surface 18 is maintained in close contact with the wall. It is the manifest purpose of our novel device to cut a sheet of vinyl (or other such floor covering) so that the cut edge of the vinyl will be exceedingly straight, and will closely conform with the wall. In the embodiment illustrated in these figures, the surfaces 14 and 18 of the base member 12 intersect in a straight line, which we regard as being the intersection location 20; note FIG. 2.

The elongate surface of the elongate base member opposite the intersection location 20 is thus to be seen as the curved surface 24 which, as best seen in FIGS. 1 through 3, is preferably of concave or arcuate shape. It is against the surface 24 that a vinyl sheet 28 is in close contact during the installation procedure, as indicated in FIGS. 2 and 3. The vinyl sheet 28 residing against the curved vinyl-receiving surface 24 is cut by the cutting blade 36 carried in a cantilevered location in a forward part of our device, as is clearly visible in FIG. 1. The cutting blade 36 is of narrow, elongate configuration, with the position of the blade 36 with respect to the concave surface 24 and the intersection location 20 being schematically illustrated in FIG. 2. Also visible in FIG. 2 is an indication of how the cut edge 26 of the vinyl can fall closely against the adjacent wall. It is to be understood that the curved configuration of the surface 24 as depicted in FIGS. 2 and 3 is essentially consistent along the length (longitudinal extent) of the elongate base member 12.

Figures 8, 8A:
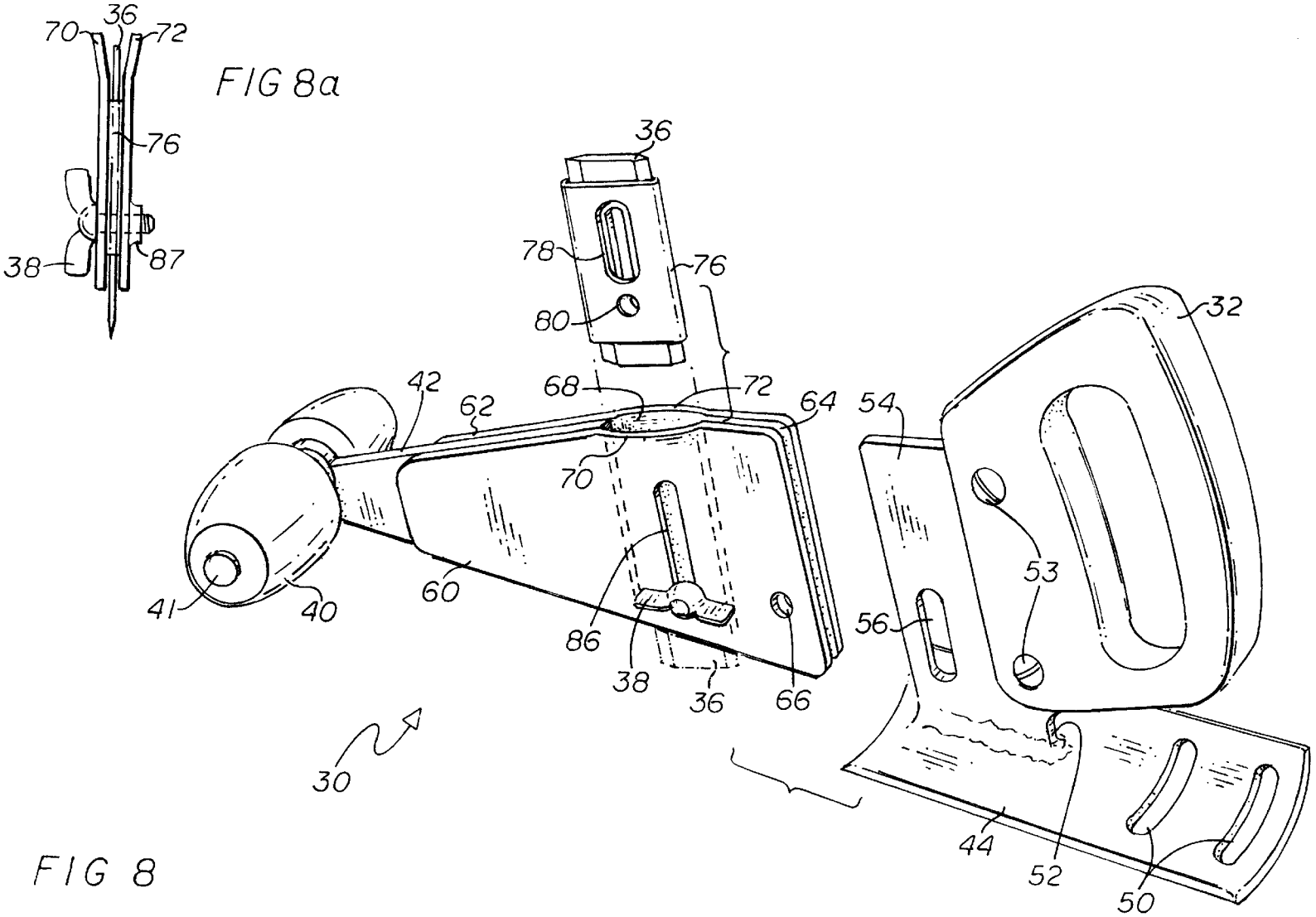
FIG. 8 is a view showing additional details of the mounting base and the vertically disposed slot provided therein in order that the height of the pressure-applying rollers with respect to the concave surface of the base member can be readily adjusted.
FIG. 8*a* is a fragmentary edge view showing how the blade carrier of FIG. 8 can be received between two outwardly bulging structural members, and be vertically adjustable therebetween.

Utilized in combination with the elongate base member 12 is a cutter assembly 30, principally made up of a handle 32, the cutting blade 36, means for adjusting the position of the cutting blade, and a pressure-applying member; note FIG. 8. In the preferred instance, the pressure-applying member involves a pair of rollers 40, which are mounted in a cantilever manner on the front of the cutter assembly 30. The rollers 40 are installed on an axle 41 located in the forwardly extending structural member 42 of adjustable height. The axle 41 is supported by the use of a low-friction bearing 43; note FIG. 3. A vinyl-receiving aperture A is defined between the rollers 40 and the concave surface 24, as indicated by stippling in FIG. 3. I prefer to regard this as the entry location for the sheet of vinyl or other floor covering to be trimmed by the use of our novel device.

The wingnut 38 with integral threaded portion depicted in FIGS. 1, 5 and 8 is associated with the means for adjusting the height of the cutting blade 36 with respect to the arcuate vinyl-receiving surface 24, whereas the wingnut 39 with integral threaded portion depicted in FIGS. 1 and 5 is associated with the height adjustment of the pressure applying rollers 40 with respect to the surface 24. The construction of these components will be discussed in detail hereinafter.

During the operation of our novel device, the operator or installer grasps the handle 32 and causes an edge of a vinyl sheet 28 to enter the entry location A (FIG. 3), after which the installer moves the elongate base member 12 to the intersection location of the floor and wall. He then moves the base member along this floor-wall intersection in the general manner illustrated in FIG. 4. At that time, the intersection location 20 extending along the backside of the elongate base member or angle block 12 resides in close conformity with the floor-wall intersection. During this movement of the elongate base member 12 longitudinally along the floor-wall intersection, the cutting blade 36 moves along the vinyl (or other floor covering), serving to cut the vinyl in such a precise manner that the cut edge can be expected to fall closely and evenly along the floor-wall intersection at such time as the cutting procedure has been completed.

It is most important to note that the sharp cutting blade 36 is mounted in the cantilevered portion of the cutter assembly, with the point of the blade 36 spaced closely adjacent the concave or arcuate surface 24 of the angle block or base member 12. It is important to note that the cutter blade 36 is to be disposed in a carefully established relationship with the intersection location 20 disposed along the rear surface of the angle block 12. As previously mentioned with regard to FIG. 2, as the base member 12 moves along the floor-wall intersection, the freshly cut edge 26 of the vinyl can be expected to drop closely in place alongside the wall.

With respect to the blade support, and with particular reference to FIG. 5, it will be noted that we have secured a mounting base 44 upon the concave surface 24, with the mounting base having a curved lower portion conforming to the curvature of the concave surface 24; note also FIG. 6. FIG. 5 (and FIG. 1) reveal that the mounting base 44 is held in position by a pair of screws 46. From FIGS. 1 and 5 it will be seen that a pair of elongate slots 50 have been cut or otherwise formed in the curved mounting base 44, which slots are of such a spacing as to coincide with the spacing of pairs of threaded holes 48 that are located in the concave surface 24. The pair of holes 48 visible in FIG. 5 are provided for use when our novel device is to be utilized by a user that is left handed. When, as illustrated in FIG. 5, our novel device is configured for use by a right handed user, a second pair of holes 48, not visible in either FIG. 1 or FIG. 5, receive the screws 46 such that the mounting base 44 can be firmly held against the elongate concave surface 24.

By the mounting base 44 having an underside of a configuration and curvature closely conforming to the curvature of the concave or arcuate surface 24, and being provided with the curved, elongate slots 50, the mounting base 44 is able to be repositioned, as needed, along the concave surface 24 in a generally lateral (non-longitudinal) manner. In other words, by virtue of the utilization of the elongate slots 50, upon the screws 46 being loosened, the mounting base 44 can be moved closer to, or further from, the floor upon which the vinyl is being laid. After a lateral adjustment serving to cause the cut floor covering to coincide with the floor-wall intersection, the screws 46 are of course retightened. The capability of the mounting base to be adjusted in a lateral manner is depicted in FIG. 6 by the use of the pair of arrows. The purpose for this adjustability will be further discussed at length hereinafter.

By now it should be clear that inasmuch as some users of our novel trimmer device may be right handed, and some left handed, by establishing a spaced pair of threaded mounting holes 48 at two widely different locations on the elongate concave surface 24, the mounting member 44 can be readily attached either on the right hand end or the left hand end of the elongate base member 12.

FIG. 6 makes clear that rigidly mounted at a right angle to the arcuately curved mounting base 44 is a mounting frame 52, and it is to the mounting frame 52 that the handle 32 is securely attached, typically by the use of a plurality of screws 53; note FIGS. 1, 5, 6 and 8. The mounting frame 52 also serves, as best seen in FIG. 8, to support the cutter assembly 30 in a substantially perpendicular relationship to the concave surface 24.

Considering FIG. 8 in more detail, the mounting frame 52 is configured to provide the support for the forwardly extending structural member 42 that directly serves as the support for the pressure-applying rollers 40, which are mounted in a cantilever manner above the concave or arcuate surface 24. It is to be understood that the mounting frame 52 has a non-movable relationship with the mounting base 44, and as made clear from FIG. 8, the mounting frame 52 has a flat, vertically extending mounting member 54, adjacent a forward edge of which a vertically extending elongate slot 56 is provided.

Rigidly attached to the structural member 42 at a location somewhat removed from the pressure-applying rollers 40 are a pair of essentially flat plates 60 and 62, which are spaced slightly apart so as to define a component-receiving receptacle 64 at the end remote from the rollers 40. It is into the receptacle 64 that the flat, vertically extending mounting member 54 can be received. The spacing of the plates 60 and 62 is such that the vertically extending member 54 is snugly received therebetween.

When as depicted in FIGS. 1 and 5 the receptacle 64 has been moved into an operative relationship with the flat, vertically extending member 54, it is to be understood that the elongate slot 56 in the vertically extending member 54 moves into coincidence with an aperture 66 provided in plate 60; note FIG. 8. It is in the aperture 66 that the threaded portion of the wingnut 39 depicted in FIGS. 1 and 5 is to be received. As is obvious, before the members 54 and 64 are to be moved into an interfitting relationship, the wingnut 39 and its integral threaded portion are removed so that the slot 56 can be readily moved into alignment with the aperture 66. A hole or aperture (not shown) is provided in the plate 62 in alignment with the aperture 66 in plate 60, with the hole in plate 62 being threaded so that the threads of the wingnut 39 can be tightly received therein.

Because the elongate slot 56 extends vertically, it is obvious that upon the wingnut 39 being loosened, the receptacle 64 as well as the forwardly extending structural member 42 can be moved vertically so as to achieve a desired relationship between the pressure-applying rollers 40 and the concave surface 24. As previously mentioned, the rollers 40 are deliberately spaced for a slight extent away from the concave surface 24 so as to create an aperture A or entry location for the edge of a sheet of vinyl to enter. After the appropriate relationship of the rollers to the concave surface has been achieved, the wingnut 39 is of course tightened so as to maintain the proper roller spacing, and a desired amount of pressure on the vinyl sheet.

With continued reference to FIG. 8, by the appropriate configuring of plates 60 and 62, we have created a blade-receiving pocket 68, made up of an outwardly bulging portion 70 on plate 60, and an outwardly bulging portion 72 established on plate 62. The outwardly bulging portions 70 and 72 together define the pocket 68 in which a blade carrier 76 is to be received. In FIG. 8 the blade carrier 76 is shown in exploded relation to the pocket 68, and in FIG. 8*a,* the blade carrier is revealed to be comparatively narrow.

The blade carrier 76 is typically constructed of comparatively thin, rather flexible steel, and is sized so that a double edge blade of the type commonly used in the installation of carpet and vinyl may be received therein. The cutting blade 36 has an elongate slot extending along its mid portion, through which the integral threaded portion of the wingnut 38 can extend. The width of the blade carrier is typically slightly greater than the width of the double edge blade, so that the cutting edges of the blade will not become dulled from undesirable contact with interior surfaces of the end portions of the blade carrier.

FIG. 8 reveals that the blade carrier 76 is somewhat shorter than the blade 36, so that the height of the blade 36 with respect to the blade carrier 76 can be readily adjusted.

With continued reference to FIG. 8, it will be noted that an elongate slot 78 is formed in the blade carrier 76, with this making it readily possible for the vinyl or carpet installer to use his thumb or forefinger in adjusting the blade position with respect to the carrier 76. Also provided in the blade carrier 76 is a bolt-receiving aperture 80, with it to be understood that a substantially identical aperture is provided in the side of the blade carrier not visible in FIG. 8.

Upon the wingnut 38 and its integral threaded portion being removed from the area of the pocket 68 defined by members 70 and 72, it is apparent that the blade carrier 76 can be inserted into the pocket, with the aperture or hole 80 in the blade carrier being in substantial coincidence with the elongate slot 86 formed in the outwardly bulging portion 70. A comparable elongate slot, not visible in FIG. 8, is formed in the outwardly bulging portion 72, with this unseen slot being in a parallel relation to the slot 86.

After the blade carrier 76 has been inserted into the pocket 68 formed by members 70 and 72, it is apparent that the integrally threaded portion of the wingnut 38 can be inserted through the elongate slot 86 provided in member 70 and through the hole 80 provided in the blade carrier 76, and thereafter emerge in the elongate slot provided in the outwardly bulging member 72. Because the slot 86 and the comparable slot in member 72 are elongate, it is obvious that by loosening the wingnut 38, the wingnut can move along the slot 86, and the blade carrier 76 can move vertically in the pocket 68 so that the cutting edge of the blade 36 will be disposed in an appropriate position with respect to the curved surface 24 in order that the vinyl can be accurately cut. Because the integral threaded portion associated with wingnut 38 passes through the hole 80 in the blade carrier 76, it is obvious that the height of the blade carrier 76 and the blade 36 residing therein can be adjusted over a wide range by the user appropriately positioning the wingnut and its integral threaded portion.

Upon the proper blade height being achieved, it is quite apparent that the wingnut 38 can be tightened and thus hold the blade carrier 76 and the blade 36 very tightly in the preferred position.

With regard to FIG. 8*a,* it is to be seen that the narrow blade carrier 76 has been received between the outwardly bulged portions 70 and 72. It is also apparent from FIG. 8*a* that a threaded nut 87 is utilized to receive the integral, threaded portion of the wingnut 38. The threaded nut 87 is designed to be slidable in a non-rotatable manner along the elongate slot in outwardly bulging portion 72, latter slot being in a parallel relation to the slot 86 depicted in FIG. 8.

It can be appreciated that from time to time the cutting blade 36 can become dulled, with it therefore being necessary for the blade 36 to be moved with respect to the concave surface 24 so as to present what may be regarded as a fresh cutting edge. By loosening the wingnut 38 it is obvious that the user can readily adjust the up and down location of the cutting blade 36.

To make it possible for the blade 36 to be moved over a wide range with respect to the concave surface 24, we have provided at least one notch 74, but preferably a plurality of notches in the concave surface, which are to be seen in FIGS. 2 and 3.

It has previously been mentioned that the mounting base 44 can be moved in a lateral or non-longitudinal sense with respect to the concave surface 24, with such lateral movement of the mounting base causing the cutting blade 36 to move into a different relationship with the concave surface, so that a particular vinyl sheet can best be dealt with. In other words, the cutting blade 36 can be moved either closer to the floor, or further from the floor. In view of this blade adjustability in a lateral sense, which makes it possible for each sheet of floor covering to be cut in coincidence with the location of the adjacent wall, we provide for a heightwise adjustability of the cutting blade 36 with respect to the concave surface 24. More particularly, we typically provide the aforementioned notches 74 in the concave surface 24, so that despite a lateral repositioning of the mounting base, the cutting blade 36 can change its depth relationship to the concave surface, and in some instances actually extend for a limited extent into the surface 24.

Because of the fact that some vinyl sheets are thicker than other vinyl sheets, it becomes necessary from time to time to change the distance of the pressure-applying rollers 40 to the concave surface 24. It was previously pointed out that in FIG. 3, an entry location or aperture A is defined between the pressure applying means, typically rollers 40, and the concave surface 24. By the installer inserting the aperture A over an edge of a sheet of vinyl, the vinyl may move along what may be described as a longitudinal path of travel of the vinyl with respect to the cutting blade 36 and the curved surface 24.

It has already been mentioned that the cutting blade 36 is mounted in a substantially perpendicular relationship to the concave surface 24 and in alignment with the path of travel of the vinyl along the concave surface, and it is to be noted that the blade 36 is located directly in front of the mounting frame 52 of FIG. 6. Therefore, because the relative motion of the vinyl with respect to the cutting blade 36 causes a severing of the vinyl, the cut edges of the vinyl can easily pass by the mounting frame 52 without the frame 52 interfering with the movement of the vinyl cutter along the sheet of vinyl.

It is now to be seen that upon an installer grasping the handle 32 and inserting the device upon an edge of a sheet of vinyl or other floor covering in the manner shown in FIG. 4, the device can be caused to move across the sheet, with the cutting blade 36 cutting the vinyl in such a carefully controlled relationship as to assure that the freshly cut edge of the floor covering will precisely coincide with the location where the wall joins the floor.

In use, the installer places this novel device on the edge of the vinyl to be cut, with the portion of the vinyl lying up against the wall in the manner shown in FIG. 4 extending between the concave surface 24 of the angle block, and the undersurface of the rollers 40 that are located on the protruding front portion of the cutter member 10. A right-handed installer then proceeds to move the angle block or base member 12 and its attached cutter member in a right-to-left direction along the intersection of the floor and wall, with the intersection location 20 on the rear of the block 12 at all times passing closely along the floor-wall intersection during this longitudinal movement of the block 12.

This causes the carefully positioned cutter blade 36 to move in a precise relationship to the location where the wall and the floor intersect, and to accomplish a very straight, precisely accurate severing of the sheet of vinyl. After the angle block 12 has been moved all the way to the far edge of the vinyl sheet and the angle block 12 has been removed from the intersection of the floor and wall, the freshly cut edge of the vinyl will be enabled to lie precisely against the wall in a highly desirable, straight manner.

As is obvious, the presetting of the relationship of the blade 36 to the intersection location 20 is critical to proper operation of our novel device. It should now be clear, from the construction illustrated in FIG. 5, that the cutting blade can be laterally adjusted either up the slope or down the slope of the curved surface 24, so as to enable our novel trimmer device be usable when cutting either a thick floor covering or a thin floor covering. This lateral adjustment is of course possible when the screws 46 have been loosened, with it to be understood that after the desired adjustment has been made, the screws 46 are retightened so as to retain the curved mounting base 44 firmly in the selected location on the concave surface 24. During all of these adjustments, the rollers 40 are to remain in a closely spaced relationship to the concave surface 24 that is consonant with the thickness of the floor covering being installed and a desirable amount of pressure applied to the sheet of floor covering.

With reference to FIGS. 6 and 7, it is to be noted that another embodiment of our invention can involve a plate 88 containing a series of rollers 90 mounted in a spaced, parallel relationship. The rollers 90 are intended to engage and roll along the wall surface as the intersection location 20 on the backside of the elongate base member 12 is moved along the floor-wall intersection. The presence of the rollers 90 assures less friction than if the rear surface of the base member was entirely flat. The plate 88 is held to the wall-contacting surface 18 of the elongate base member by the use of screws 92, so it can be readily installed when needed, or rapidly removed from the elongate base member when no longer needed.

From time to time it may be appropriate to secure a plate containing a series of rollers mounted in a spaced, parallel relationship to the floor-contacting surface 14 of the base member 12. As will be noted from FIGS. 9 and 10, rollers 96 individually supported by members 98 on plate 94 are provided in a spaced, parallel array in accordance with this embodiment, which rollers 96 are intended to engage and roll along the floor as the elongate base member is moved along the floor-wall intersection. This arrangement is ideal in some instances, but the rollers are not to be used in a floor-contacting relationship when mastic or cement has been laid down on the floor.

The various structural components, such as the mounting base 44, the vertically extending member 54, the plates 60 and 62, and the forwardly extending structural member 42 are of sturdy construction, preferably of metal, such as stainless steel. The base member 12 may be made of aluminum and the rollers 40 may be made of a sturdy plastic. We are not, however, to be limited to any particular materials in the construction of our trimmer device.

By now it should be obvious that our novel trimmer device can be utilized by even an apprentice vinyl installer inasmuch as by the installer maintaining the base member 12 in a closely fitting relationship to the floor-wall intersection, the cutting blade will assuredly cut the vinyl or other floor covering in a smooth and even manner such that the cut edge of the vinyl is readily movable into a closely fitting relationship to the wall. Our device can be manufactured economically, and will enable an installer to cut a sheet of vinyl much more rapidly and much more accurately than is possible utilizing the older, less reliable procedures.

What is claimed is:

1. A hand operated trimmer for trimming an edge of floor covering provided in sheet form that is being installed on a floor so that the cut edge of the floor covering will lie closely against an adjacent wall, said trimmer comprising a cutting blade having a cutting edge, and an elongate base member having means supporting said cutting blade disposed thereon, said means supporting said cutting blade comprising a mounting base, wherein said elongate base member has elongate external surfaces arrayed so as to define a generally triangularly shaped cross section, with two of said elongate external surfaces of said base member meeting essentially at a right angle, and the other elongate external surface which is opposite said right angle providing an open and substantially unbounded covering-receiving surface for receiving the floor covering, said cutting blade being mounted closely adjacent said covering-receiving surface and in a substantially perpendicular relationship thereto, and pressure applying means for pressing the sheet of floor covering against said open covering-receiving surface, said pressure applying means being supported by said mounting base and being spaced a slight distance from said covering-receiving surface so as to define a covering-receiving entry location for the sheet of floor covering to pass longitudinally along said open covering-receiving surface, said cutting blade being mounted such that said cutting edge resides substantially in a plane that extends in a longitudinal direction of said base member for alignment with the intended direction of travel of the floor covering as it moves along said open covering-receiving surface, whereby upon an installer inserting into said trimmer the edge of the sheet of floor covering, the sheet of floor covering separating somewhat from the floor and entering said entry location, the external surfaces of said base member meeting at a right angle can be moved along the intersection of the floor with the wall, with said cutting blade cutting the sheet of floor covering at a location that will coincide with the intersection of the floor with the adjacent wall.

2. The hand operated trimmer as recited in claim 1 wherein said open covering-receiving surface is of concave configuration.

3. The hand operated trimmer as recited in claim 1 wherein one of the external surfaces of said base member meeting essentially at a right angle forms a floor-contacting member, and the other of said external surfaces meeting essentially at a right angle forms a wall-contacting member, and a series of narrow floor-contacting components on said floor-contacting member are provided for the purpose of lessening friction.

4. The hand operated trimmer as recited in claim 3 wherein said narrow floor-contacting components on said floor-contacting member are rigid teeth that are disposed in a parallel relationship to said elongate external surfaces and extend in said longitudinal direction of said base member.

5. The hand operated trimmer as recited in claim 3 wherein said narrow floor-contacting components on said floor-contacting member are rollers that extend axially in a perpendicular relationship to one of said elongate external surfaces and perpendicular to said longitudinal direction of said base member.

6. The hand operated trimmer as recited in claim 1 wherein one of the external surfaces of said base member meeting essentially at a right angle forms a floor-contacting member, and the other of said external surfaces meeting essentially at a right angle forms a wall-contacting member, and a spaced series of rollers on said wall-contacting member of said base member are arranged parallel to one another to roll along the adjacent wall contacted by said base member for the purpose of lessening friction.

7. The hand operated trimmer as recited in claim 1 in which said means supporting said cutting blade further comprises means for laterally adjusting said cutting blade with respect to said covering-receiving surface, with said cutting blade having a tip, and said means for laterally adjusting said cutting blade making it possible for a user to adjust the distance between said tip of said cutting blade and the floor, so that the floor covering will be cut at a location coinciding with the intersection of the floor with the adjacent wall.

8. The hand operated trimmer for trimming an edge of floor covering provided in sheet form that is being installed on a floor as recited in claim 1 wherein said floor covering is vinyl.

9. The hand operated trimmer for trimming an edge of floor covering provided in sheet form that is being installed on a floor as recited in claim 1 wherein said floor covering is carpet.

10. A hand operated trimmer for trimming an edge of floor covering provided in sheet form that is being installed on a floor so that the cut edge of the floor covering will lie closely against an adjacent wall, said trimmer comprising a cutting blade having a cutting edge, and an elongate base member, said base member having elongate external surfaces arrayed so as to define a generally triangularly shaped cross section, with two of said elongate external surfaces of said base member meeting essentially at a right angle, and the elongate external surface opposite said right angle providing an open and substantially unbounded covering-contacting surface for receiving the floor covering, a cutter assembly connected to said base member and supporting said cutting blade closely adjacent said open covering-contacting surface and in a substantially perpendicular relationship thereto, said cutter assembly comprising a handle, a height adjustment means for said cutting blade, and pressure applying means for pressing the sheet of floor covering against said open covering-contacting surface, said pressure applying means being spaced a slight distance from said covering-contacting surface so as to define a covering-contacting entry location for the sheet of floor covering to pass longitudinally along said open covering-contacting surface, said cutting blade being mounted such that said cutting edge resides substantially in a plane that extends in a longitudinal direction of said base member for alignment with the intended direction of travel of the floor covering as it moves along said open covering-contacting surface, whereby upon an installer grasping said handle and inserting into said trimmer the edge of the sheet of floor covering, the sheet of floor covering separating somewhat from the floor and entering said entry location, the installer is able to move the external surfaces of said base member meeting essentially at a right angle along the intersection of the floor with the wall, with said cutting blade cutting the floor covering at a location that will coincide with the intersection of the floor with the adjacent wall.

11. The hand operated trimmer as recited in claim 10 wherein said covering-contacting surface is of concave configuration.

12. The hand operated trimmer as recited in claim 10 wherein one of the external surfaces of said base member meeting essentially at a right angle forms a floor-contacting member, and the other of said external surfaces meeting essentially at a right angle forms a wall-contacting member, and a series of narrow floor-contacting components on said floor-contacting member are provided for the purpose of lessening friction.

13. The hand operated trimmer as recited in claim 12 wherein said narrow floor-contacting components on said floor-contacting member are rigid teeth that are disposed in a parallel relationship to said elongate external surfaces and extend in said longitudinal direction of said base member.

14. The hand operated trimmer as recited in claim 12 wherein said narrow floor-contacting components on said floor-contacting member are rollers that extend axially in a perpendicular relationship to one of said elongate external surfaces and perpendicular to said longitudinal direction of said base member.

15. The hand operated trimmer as recited in claim 10 wherein one of the external surfaces of said base member meeting essentially at a right angle forms a floor-contacting member, and the other of said external surfaces meeting essentially at a right angle forms a wall-contacting member, and a spaced series of rollers on said wall-contacting member of said base member are arranged parallel to one another to roll along the adjacent wall contacted by said base member for the purpose of lessening friction.

16. The hand operated trimmer as recited in claim 10 in which said cutter assembly further comprises means for laterally adjusting said cutting blade with respect to said covering-contacting surface, with said cutting blade having a tip and said means for laterally adjusting said cutting blade making it possible for the installer to adjust the distance between said tip of said cutting blade and the floor, so that the floor covering will be cut at a location coinciding with the intersection of the floor with the adjacent wall.

17. The hand operated trimmer for trimming an edge of floor covering provided in sheet form that is being installed on a floor as recited in claim 10 wherein said floor covering is vinyl.

18. The hand operated trimmer for trimming an edge of floor covering provided in sheet form that is being installed on a floor as recited in claim 10 wherein said floor covering is carpet.

19. A hand operated trimmer for trimming an edge of floor covering provided in sheet form being installed on a floor so that the cut edge of the floor covering will lie closely against an adjacent wall, said trimmer comprising an elongate base member intended to be moved by a user of the trimmer along an intersection of the floor with the adjacent wall, said base member having elongate external surfaces defining a generally triangularly shaped cross section, with two of said elongate external surfaces of said base member meeting essentially at a right angle, and the elongate external surface opposite said right angle comprising a concave surface, a mounting base having a configuration substantially consistent with the curvature of said concave surface, with said mounting base mounted in a laterally adjustable manner upon said concave surface, a cutter assembly supported by upon said mounting base, said cutter assembly comprising a handle, a cutting blade having a cutting edge with a tip disposed closely adjacent said concave surface, height adjustment means for said cutting blade, and pressure applying means for pressing the sheet of floor covering against said concave surface, said pressure applying means being spaced a slight distance from said concave surface so as to define a covering-contacting entry location for the sheet of floor covering to pass longitudinally along said concave surface, said cutting blade being mounted such that said cutting edge resides substantially in a plane that extends in a longitudinal direction of said base member for alignment with the intended direction of travel of the sheet of floor covering as it moves along said concave surface, with the lateral adjustability of said mounting base making it possible for the user to adjust the distance between the tip of said cutting blade and the floor, such that the user can assure that the cut edge of the floor covering will coincide with the location of the adjacent wall, whereby upon the user grasping said handle and inserting into said device the edge of the sheet of floor covering, the sheet of floor covering separating somewhat from the floor and entering said entry location, the user is able to move the external surfaces of said base member meeting at essentially a right angle along the intersection of the floor with the wall, with said cutting blade cutting the sheet of floor covering at a location that will coincide with the intersection of the floor with the adjacent wall.

20. The hand operated trimmer as recited in claim 19 wherein one of the external surfaces of said base member meeting essentially at a right angle forms a floor-contacting member, and the other of said external surfaces meeting essentially at a right angle forms a wall-contacting member, and a series of narrow floor-contacting components on said floor-contacting member are provided for the purpose of lessening friction.

21. The hand operated trimmer as recited in claim 20 wherein said narrow floor-contacting components on said floor-contacting member are rigid teeth that are disposed in a parallel relationship to said elongate external surfaces and extend in said longitudinal direction of said base member.

22. The hand operated trimmer as recited in claim 20 wherein said narrow floor-contacting components on said floor-contacting member are rollers that extend axially in a perpendicular relationship to one of said elongate external surfaces and perpendicular to said longitudinal direction of said base member.

23. The hand operated trimmer as recited in claim 19 wherein one of the external surfaces of said base member meeting essentially at a right angle forms a floor-contacting member, and the other of said external surfaces meeting essentially at a right angle forms a wall-contacting member, and a spaced series of rollers on said wall-contacting member of said base member are arranged parallel to one another to roll along the adjacent wall contacted by said base member for the purpose of lessening friction.

24. The hand operated trimmer as recited in claim 19 in which at least one notch or groove is formed in said concave surface in the immediate vicinity of said cutting blade, into which the tip of said cutting blade may extend.

25. The hand operated trimmer as recited in claim 19 wherein said cutter assembly further comprises pressure adjustment means for selectively adjusting the pressure applied by said pressure applying means enabling a selective adjustment of the pressure placed upon the sheet of floor covering by said pressure applying means.

26. The hand operated trimmer for trimming an edge of floor covering provided in sheet form that is being installed on a floor as recited in claim 19 wherein said floor covering is vinyl.

27. The hand operated trimmer for trimming an edge of floor covering provided in sheet form that is being installed on a floor as recited in claim 19 wherein said floor covering is carpet.

* * * * *